US005331911A

United States Patent [19]

Bost et al.

[11] Patent Number: 5,331,911

[45] Date of Patent: Jul. 26, 1994

[54] MARINE SANITATION HOLDING VESSEL

[75] Inventors: Merlin Bost; Glen Fredholm, both of Anacortes, Wash.

[73] Assignee: American Eagle Aluminum Manufacturing, Inc., LaConner, Wash.

[21] Appl. No.: 929,661

[22] Filed: Aug. 12, 1992

[51] Int. Cl.[5] ..... B63B 35/28

[52] U.S. Cl. ..... 114/26; 114/74 R; 114/211

[58] Field of Search ..... 114/26, 27, 74 R, 74 J, 114/256, 211; 4/347, 321

[56] References Cited

U.S. PATENT DOCUMENTS

| | | | |
|---|---|---|---|
| 2,021,629 | 11/1935 | Leigh | 114/26 |
| 2,091,784 | 8/1937 | Leigh | 114/74 R |
| 2,299,992 | 10/1942 | Kennedy | 114/26 |
| 2,356,391 | 8/1944 | Fluor, Jr. | 114/211 |
| 3,320,621 | 5/1967 | Vita | 4/321 |
| 3,474,467 | 10/1969 | Stinson | 4/321 |
| 3,551,916 | 1/1971 | Reid | 114/211 |
| 3,590,887 | 7/1971 | Quase | 114/256 |
| 3,820,488 | 6/1974 | Johnson | 4/321 |
| 4,031,574 | 6/1977 | Werner | 4/347 X |
| 4,324,007 | 4/1982 | Morris | 4/321 |
| 5,067,425 | 11/1991 | Sporleder | 114/26 |

FOREIGN PATENT DOCUMENTS

| | | | |
|---|---|---|---|
| 1164381 | 6/1985 | U.S.S.R. | 4/321 |

*Primary Examiner*—Sherman Basinger
*Attorney, Agent, or Firm*—Hughes, Multer & Schacht

[57] ABSTRACT

A marine sanitation holding vessel basically comprising a welded aluminum barge; a waste removal system mounted on the barge; and a ventilation system mounted on the barge. The barge is of modular construction and comprises three basic sections: first and second end sections and an elongate middle section. The waste removal system includes first and second pumps, a battery for storing power for operating the pumps, a receptacle for receiving waste from portable toilets, and a solar generating system for charging the battery. The first pump withdraws waste material from the holding tank to be emptied and deposits it into the barge storage tank. The second pump provides water for cleansing the receptacle for receiving waste collected in portable toilets. The ventilation system comprises a hollow mast painted black to heat the mast and thus generate an upward draft within the mast which draws the fumes from within the storage tank. The ventilation system further comprises a charcoal filter element located below the mast through which the fumes must pass while being ventilated to the surrounding environment. The mast is hinged to the barge to allow the mast to be rotated towards the horizontal to allow access to: (a) the charcoal filter element and an opening into the barge storage tank; and (b) the interior of the storage tank.

19 Claims, 5 Drawing Sheets

MARINE SANITATION HOLDING VESSEL

TECHNICAL FIELD

The present invention relates to apparatus and methods for containing sewage, and, more particularly, to such apparatus and methods for use in a marine setting and methods of manufacturing the same.

BACKGROUND OF THE INVENTION

Passengers on pleasure boats are faced with the problem of collecting and disposing of waste material including excreta and other human waste generated during the voyage. The large numbers of pleasure boats on the water today render it unsanitary to dump this waste material directly into the water; this is especially true with such relatively confined bodies of waters as lakes and coastal waterways and near marinas and other areas where large numbers of boats congregate. Accordingly, many pleasure craft are provided with self-contained bathroom facilities or portable toilets in which this waste material may be collected.

Because the holding tanks on such pleasure craft contain relatively small amounts of this waste, they must frequently be emptied. Land-based collection stations located near marinas are predominantly used to remove this waste from pleasure craft holding tanks because of the easy availability of sewer lines and power to operate pumps. However, the dock space at such marinas is limited, preventing the dedication of dock space for a waste collection stations. The dock space provided for such a collection station may also not be easily accessible. Additionally, such land-based collection sites are inappropriate in remote areas where such craft may congregate because sewer lines and power for pumping stations are not found in such remote areas; further, these remote areas may not be provided with permanent docks which can be piped to accommodate such a land-based collection station.

In at least one instance, a floating waste collection station has been provided in a lake. This collection station comprised a converted barge provided with a solar powered electric pump for pumping waste from the pleasure craft holding tank into the hold of the barge. A pleasure craft is tied up to the barge, and the operator of the pleasure craft operates the pump as necessary to empty the holding tank of his craft. While this barge was nominally effective, it suffered many problems related to the design and construction of the barge and waste removal system provided thereon.

OBJECTS OF THE INVENTION

In view of the foregoing, it is apparent that an important object of the present invention is to provide improved marine sanitation holding vessels.

Another important, but more specific, object of the present invention is to provide marine sanitation holding vessels having a favorable mix of the following factors:

a. easily and inexpensively constructed with little waste of materials;
b. simple operation;
c. ease of serviceability;
d. operates effectively at remote sites as well as more established sites;
e. easily portable by towing or trailering
f. allows efficient use of existing marina dock space; and g. modular in design to allow flexibility in construction for a particular use and site.

SUMMARY OF THE INVENTION

These and other objects are achieved by the present invention, which is a marine sanitation holding vessel basically comprising a welded aluminum barge; a waste removal system mounted on the barge; and a ventilation system mounted on the barge.

The barge is constructed in three basic sections: first and second end sections and an elongate middle section. The end sections are of standard size, while the size of the middle section may be changed to alter the capacity of the holding vessel. The barge is simply constructed primarily using standard sizes of aluminum panels welded together. The barge includes a basically obstruction free storage tank that may easily be cleaned and serviced. The barge also includes slanted panels defining the ends of the storage tank which also provide support for the side walls of the holding tank.

The waste removal system includes first and second pumps, a battery for storing power for operating the pumps, a receptacle for receiving waste from portable toilets, and a solar generating system for charging the battery. The first pump withdraws waste material from the holding tank to be emptied and deposits it into the barge storage tank. The second pump provides water for cleansing the receptacle for receiving waste collected in portable toilets.

The ventilation system comprises a hollow mast: (a) through which fumes accumulating in the storage tank may be ventilated to the outside; and (b) that provides a convenient platform for supporting the solar panels of the solar generating system. The mast is painted black to heat the mast and thus generate an upward draft within the mast which draws the fumes from within the storage tank. The ventilation system further comprises a charcoal filter element located below the mast through which the fumes must pass while being ventilated to the surrounding environment. The mast is hinged to the barge to allow the mast to be rotated towards the horizontal to allow access to: (a) the charcoal filter element and an opening into the barge storage tank; and (b) the interior of the storage tank.

Additional features of the presently disclosed invention will become apparent from the attached drawings and the following discussion thereof.

DETAILED DESCRIPTION OF THE INVENTION

Figure 1:
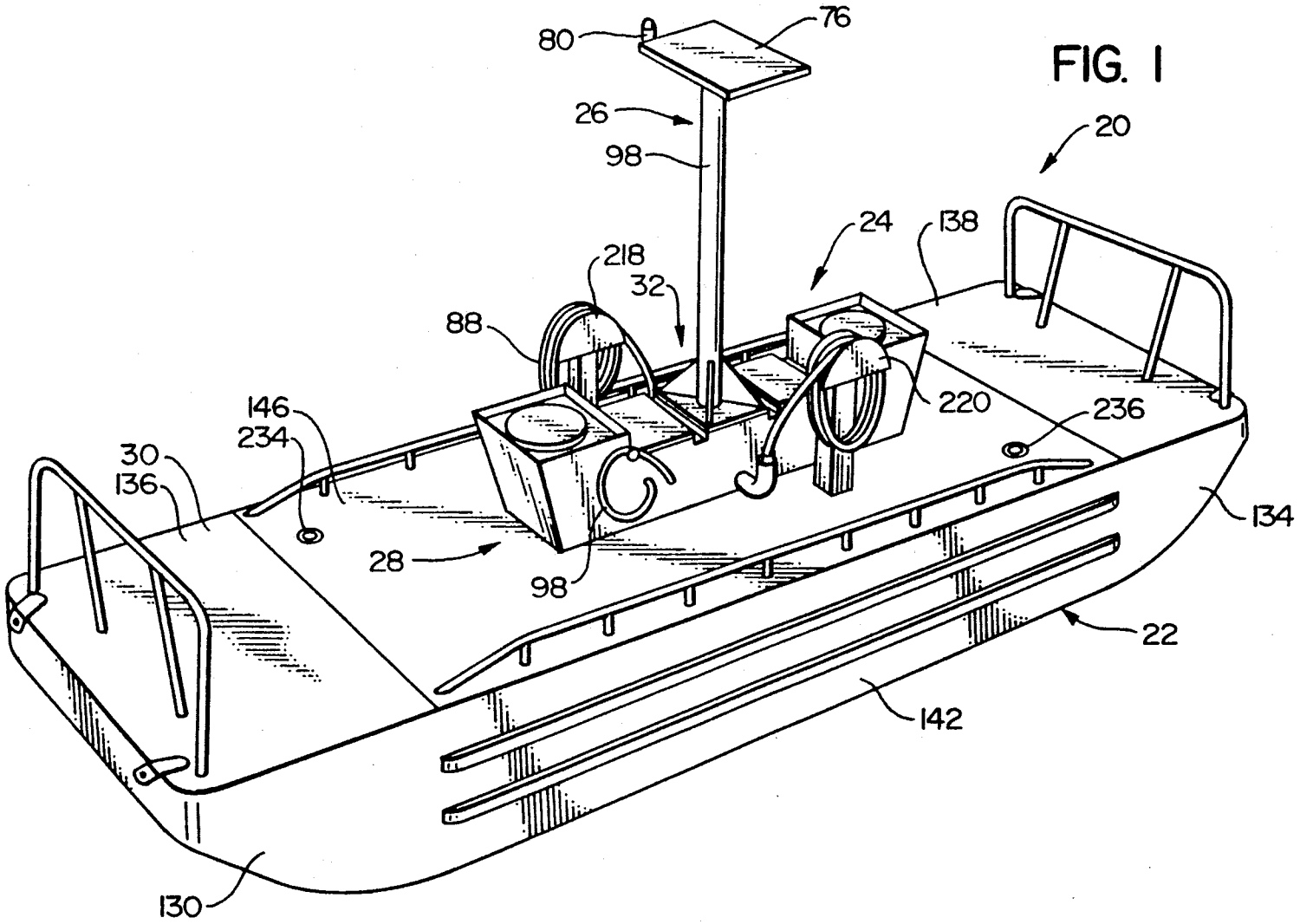
FIG. 1 is a perspective view depicting a marine sanitation holding vessel constructed in accordance with the present invention.

Referring now to the drawing, FIG. 1 depicts a marine sanitation holding vessel 20 constructed in accordance with, and embodying, the principles of the present invention. This vessel 20 basically comprises: (a) a barge 22; (b) a waste removal system generally indicated at 24; and (c) a ventilation system a portion of which is visible in FIG. 1 and indicated at reference character 26.

The waste removal system 24 is located in a center portion 28 of an upper surface or deck 30 of the barge 22. The ventilation system 26 is similarly located in a center portion 32 of the waste removal system 24. This balanced arrangement contributes to the sea-worthiness of the vessel 20 and is additionally advantageous for reasons that will become apparent below.

Figure 2:
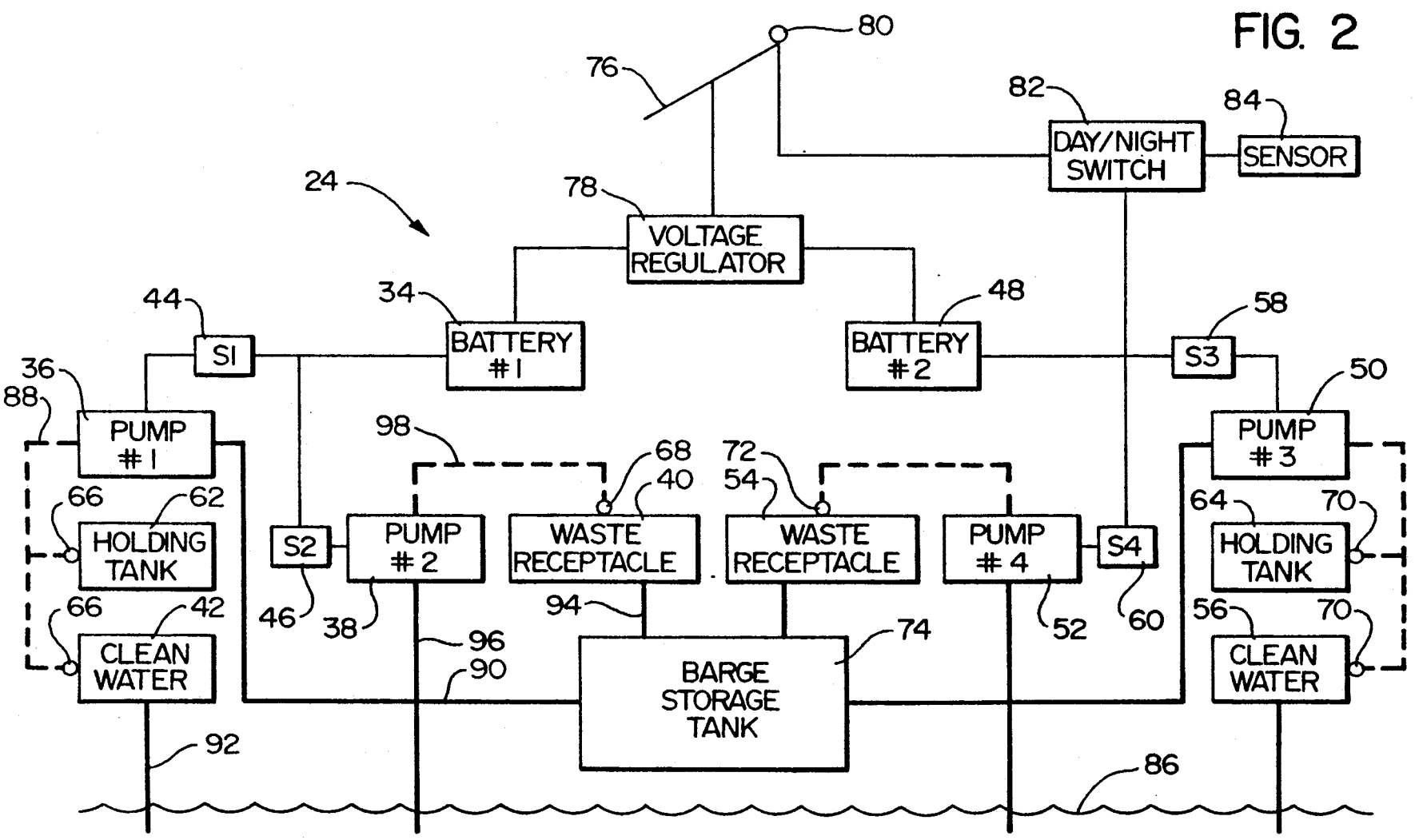
FIG. 2 is a schematic view depicting an exemplary waste removal system of the invention.

An exemplary waste removal system 24 is schematically depicted in, and will now be described in further detail with reference to, FIG. 2. As shown in that Figure, with few exceptions, the exemplary waste removal system 24 is divided into two individual systems comprising the same components. A first individual system comprises a first battery 34, first pump 36, a second pump 38, a waste receptacle 40, a clean water port 42, and first and second switches 44 and 46. A second individual system comprises a second battery 48, a third pump 50, a fourth pump 52, a waste receptacle 54, a clean water port 56, and first and second switches 58 and 60. Associated with each of these systems is a boat having a portable toilet or a holding tank such as holding tanks 62 and 64. Further, associated with each of the pumps 36, 38, 50, and 52 are nozzles or openings 66, 68, 70, and 72, respectively.

Common to these individual systems is a barge storage tank 74, a solar panel 76, and a voltage regulator 78. Separate from the individual systems comprising the waste removal system 24, but connected to one of the batteries thereof (in this case the second battery 48 associated with the second individual system), is a mooring light 80 and its associated day/night switch 82 and photo sensor 84. The water in which the barge floats is identified by reference character 86.

The various components just-described are connected by electrical conductors or wires, fixed pipes, and hoses. In FIG. 2, the wires are indicated by thin solid lines, the fixed pipes are indicated by thick solid lines, and the hoses are indicated by thick broken lines.

Each of these individual systems operates in the same basic manner, so the operation of the components of only the first of these systems will be described below with the understanding that the following discussion applies to the second of these systems.

The situation in which the boat from which waste must be removed contains the on-board holding tank 62 will initially be discussed. The operator of the boat first pulls alongside, and ties his boat to, the barge 22. The operator then takes in hand the nozzle 66 associated with the first pump 36. The operator next places the nozzle 66 into the port through which the on-board holding tank 62 may be accessed and depresses the first switch 44. The first switch 44 is a momentary switch that allows current to flow from the first battery 34 and energize the pump 36. The pump 36 causes the waste material in the holding tank to be withdrawn from the holding tank 62 through a hose 88 and dumped in the barge storage tank 74 through a pipe 90.

When the holding tank 62 has been sufficiently emptied, the first switch 44 is released, shutting off current to the pump 36. The nozzle 66 is then placed into the clean water port 42. The clean water port 42 is in communication with the water 86 through a pipe 92. The first switch 44 is depressed to again energize the pump 36. Clean water is drawn through and flushes out the hose 86 and the pipe 88. The process of emptying the holding tank 62 is thus complete and the boat operator may return to the boat.

The situation is slightly different when the boat from which waste material to be removed has the waste material stored in a portable toilet. In this case, the portable toilet is carried onto the barge 22 and manually emptied into the waste receptacle 40. The waste material passes through the receptacle 40, through a pipe 94, and into the barge storage tank 74. The boat operator must then clean the receptacle 40 and flush the pipe 94. This is accomplished by aiming the hose opening 68 towards the receptacle 40 and depressing the second switch 46. This second switch 46 is also a momentary switch which energizes the second pump 38. The second pump 38 which draws the water 86 through a pipe 96 and through a hose 98 connecting the pump 38 and the opening 68. This clean water exiting the opening 68 may be used to clean the waste receptacle and as a consequence flush the pipe 94. The process of emptying the portable toilet is now complete and the operator may return to the boat.

The solar panel 76 and voltage regulator 78 charge the batteries 34 and 48 when light impinges on this panel 76. These components 76 and 78 are available on the market and will not be discussed in further detail herein.

In response to a signal generated by the photo sensor 84, the day/night switch turns on the mooring light 80 during the night.

Figure 3:
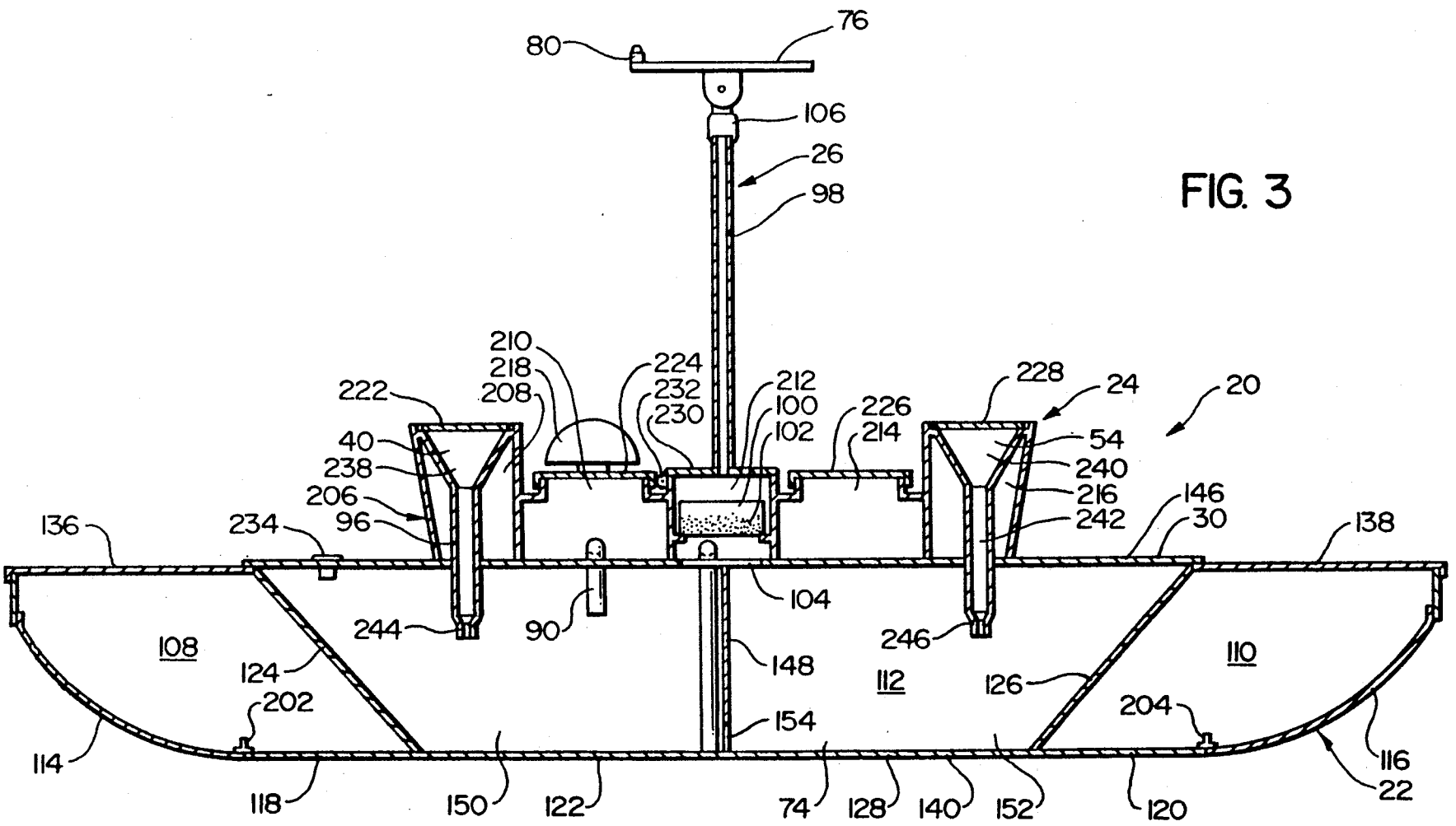
FIG. 3 is a side sectional view taken along lines 2—2 in FIG. 1.

The ventilation system 26 will now be discussed in further detail with reference to FIG. 3. As shown in FIG. 3, the ventilation system 26 comprises a hollow mast 98, a basket 100 in which charcoal 102 is placed, and a cleaning/ventilation port 104 in the barge storage tank 74. The cleaning/ventilation port 14 is formed in the barge upper surface 30 immediately below the basket 100. Vapors emitted by the waste material within the tank 74 will rise through the charcoal within the basket 100, pass through the hollow mast 98, and exit the mast 98 through openings formed in a rain hood 106 attached to the top of the mast 98. The charcoal 102 filters the air carrying these fumes. Fumes are thus prevented from accumulating within the storage tank 74.

Figure 4:
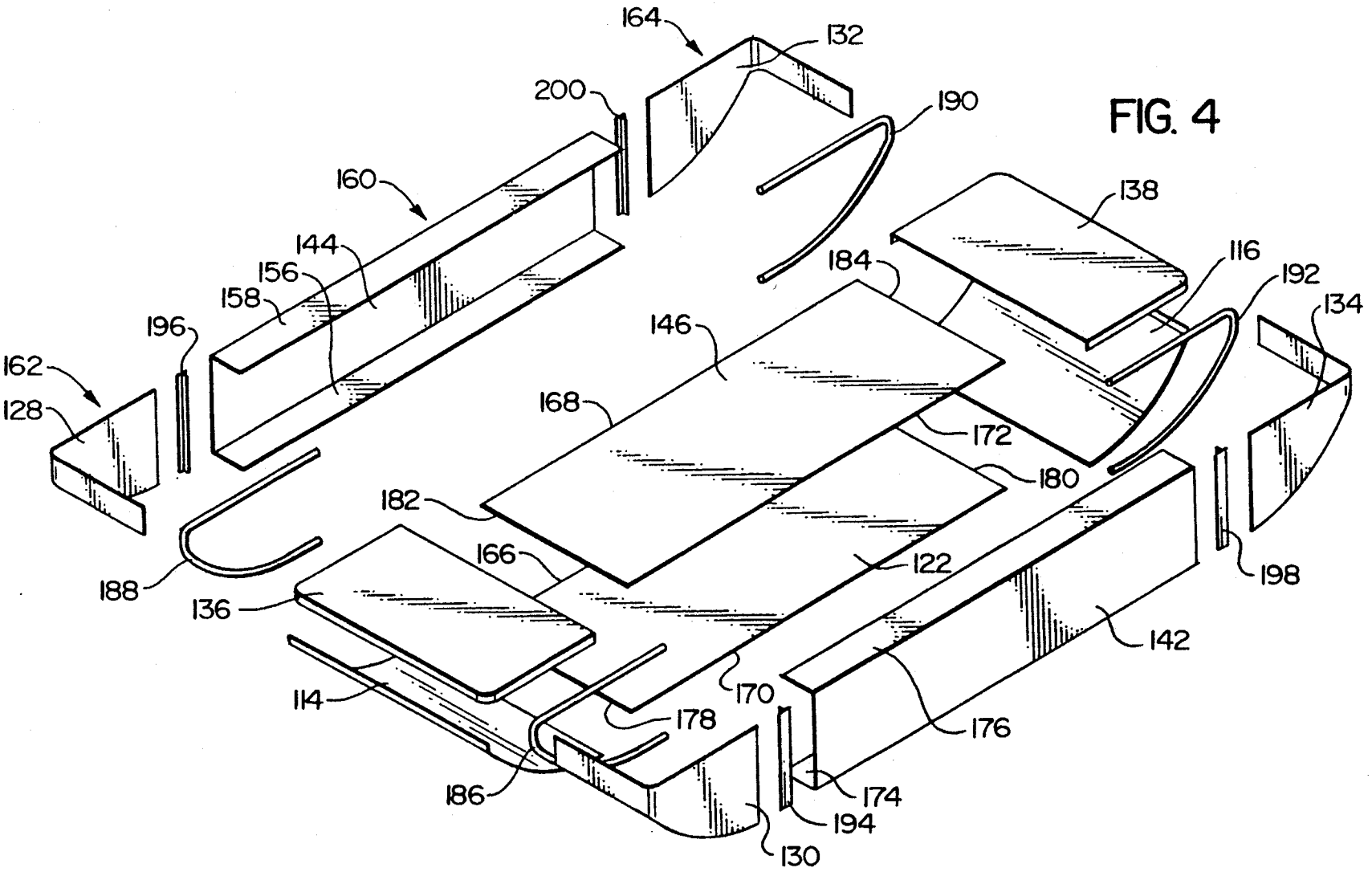
FIG. 4 is an exploded view depicting the construction of the barge portion of the present invention.

The particulars of the construction of the barge 22, including the assembly of and relationship thereto of the waste removal system 24 and the ventilation system 26, will now be described in more detail with reference to FIGS. 3 and 4. As shown in FIGS. 3 and 4, the barge 22 defines three separate compartments: a first air compartment 108, a second air compartment 110, and a storage compartment 112 defined by the storage tank 74.

The air compartments 108 and 110 are defined by first and second curved walls 114 and 116, portions 118 and 120 of a bottom wall 122, slanted interior walls 124 and 126, side walls 128, 130, 132, and 134 (FIG. 4), and first and second upper walls 136 and 138. The storage compartment 112 is defined by a portion 140 of the bottom wall 122, the interior walls 124 and 126, side walls 142 and 144 (FIG. 4), and a center upper wall 146. A baffle wall 148 divides the storage compartment 112 into a first portion 150 and a second portion 152; however, apertures 154 in this baffle wall 148 allow fluid communication between the first and second portions 150 and 152.

Referring now more particularly to FIG. 4, it can be seen that the various walls described above may be simply formed from standard-sized sheets of material, which is preferably 3/16" 5086 aluminum.

For example, the side walls 142 and 144 may be formed from standard 20'×6' sheets of 3/16" aluminum. These sheets are bent to form two inwardly directed flanges such as the flanges identified at 156 and 158 in FIG. 4. The upper and lower center walls 122 and 146 may similarly be formed from such 20'×6' sheets.

The first and second upper walls 136 and 138, curved walls 114 and 116, and slanted walls 124 and 126 (not shown in FIG. 4) may be similarly formed or cut from standard rectangular sheets. Only the side walls 128–134 need to be cut in a way that produces waste, and this waste is relatively small.

Also, by examining FIG. 4 it can further be seen that the barge can be divided into a center section 160 comprising the walls 122, 142, 144, and 146, a first end section 162 comprising the walls 114, 128, 130, and 136, and a second end section 164 comprising the walls 116, 132, 134, and 138. The end sections 162 and 164 may be assembled as units and used with center sections of various lengths. The barge is thus generally modular in design. The end sections 162 and 164 are watertight and thus provide buoyancy to the barge 22.

In assembling the barge 22, the upper wall 146 and lower wall 122 are welded to the side walls 144 and 146 such that their side edges 166, 168, 170, and 172 overlap flanges 156, 158, 174, and 176, respectively, on the side walls 142 and 144 by a minimum of 1", and preferably 2" to 3". The end edges 178, 180, 182, and 184 of these walls 146 and 122 similarly overlap, and are welded to, the first and second curved walls 114 and 116 and the first and second upper walls 136 and 138, respectively.

In addition to the walls identified above, the first and second end sections 162 and 164 further comprise generally U-shaped metal pipes 186, 188, 190, and 192. The walls 114, 130, and 136 are welded to the pipe 186, the walls 114, 128, and 136 are welded to the pipe 188, the walls 116, 132, and 138 are welded to the pipe 190, and the walls 116, 134, and 138 are welded to the pipe 192.

When the barge 22 is assembled, the ends of these pipes 186–192 protrude into the center section 160 that the walls 142 and 144 are be welded thereto to rigidly bond the end sections 162 and 164 to the center section 160.

T-bars such as the T-bars 194, 196, 198, 200 (FIG. 4), 202, and 204 (FIGS. 3 and 5) are welded along the seams formed at the junctures of the various walls to provide strength thereto.

Figure 5:
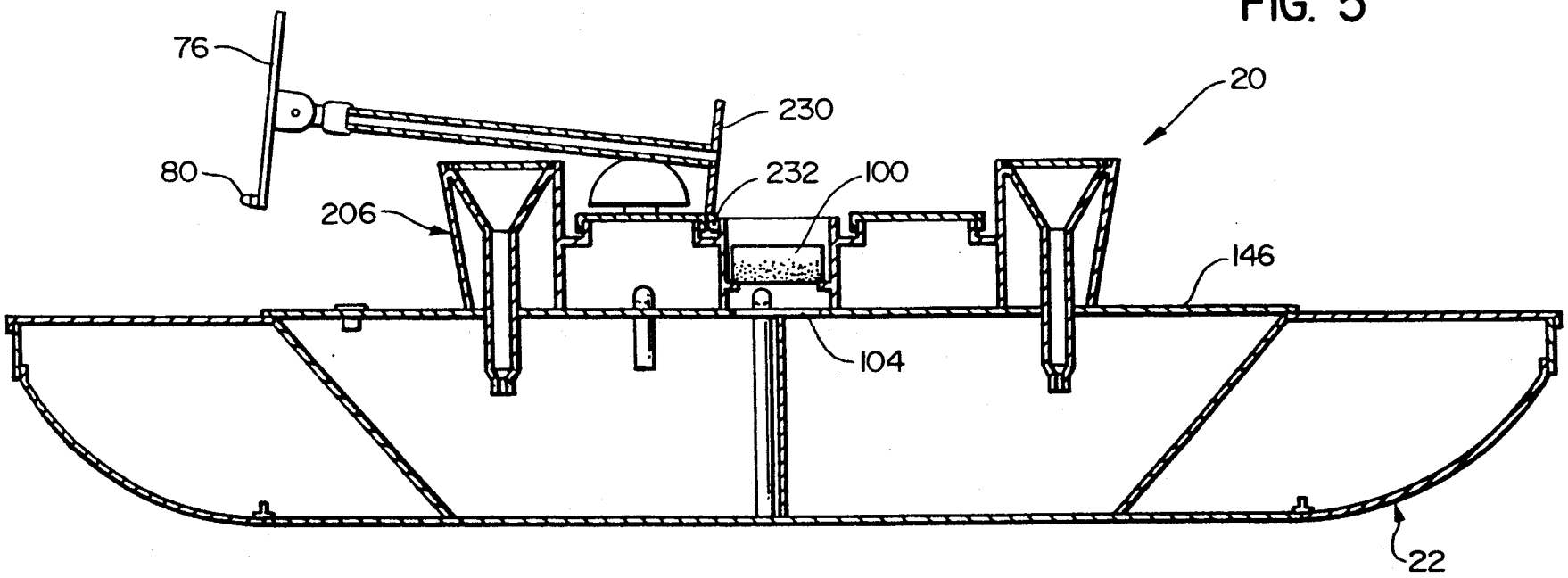
FIG. 5 is a side sectional view generally taken along lines 2—2 in FIG. 1, but showing a mast portion of the present invention rotated to allow cleaning of solar panels and access to the interior of the barge portion.

As shown in FIGS. 3 and 5, the waste removal system 24 comprises a waste removal housing 206 which defines five separate compartments. A first compartment 208 contains the first waste receptacle 40, a second compartment 210 contains the first and second pumps 36 and their associated battery 34, a third compartment 212 contains the basket 100, a fourth compartment 214 contains the third and fourth pumps 50 and 52 and their associated battery 48, and a fifth compartment 216 contains the second waste receptacle 54.

The first through fourth switches 44, 46, 58, and 60, are mounted on the housing 206 in positions convenient to the user of the system 24. The hoses associated with the various pumps are also mounted on the housing 206 on a convenient bracket such as that identified by reference characters 218 and 220 in FIGS. 1 and 3. Covers 222, 224, 226, and 228 are provided to allow access to the compartments 208, 210, 214, and 216, respectively. The covers 224 and 226 are securely locked to prevent access to their respective compartments, while the covers 222 and 228 are hinged to allow access to the compartments 208 and 216.

The mast 98 is bolted onto a cover 230 for the third compartment 212. The cover 230 is rotatably connected to the housing 206 by a hinge 232. When the cover 230 is rotated about the hinge 232 to allow access to the compartment 212, the mast 98 also rotates downwardly into the position shown in FIG. 5. This allows the solar panels 76 to be cleaned without climbing the mast 98.

Coverable ports 234 and 236 are also provided in the wall 146 to allow waste material stored in the storage tank to be removed.

After this waste material is so removed, it is desirable to rinse the inside of the tank 74. This can be accomplished by removing the charcoal basket 100 and spraying water through the aperture 104 in the wall 146.

The waste receptacles 40 and 54 are of interest. These comprises conical upper sections 238 and 240 into which the waste may be poured. These conical sections 238 and 240 communicated through pipes 96 and 242 with the interior of the storage tank 74. Reduced diameter portions 244 and 246 of these pipes 96 and 242 traps foreign matter such as beverage cans and prevents such foreign matter from entering the tank 74. Only the receptacles 40 and 54, and associated pipes 96 and 242, need be removed to remove the foreign matter placed therein.

It should be clear that the present invention may be embodied in forms other than that described above. The above-described embodiment is therefore to be considered in all respects illustrative and not restrictive, the scope of the invention being indicated by the appended claims rather than the foregoing description. All changes that come within the meaning and scope of the claims are intended to be embraced therein.

I claim:

1. A marine sanitation holding vessel for collecting and storing waste material, comprising:

a. a barge having an upper deck, the barge defining first and second end compartments and a storage compartment, where the first and second end compartments are filled with material that provides buoyancy to the barge;

b. waste removal means mounted on the upper deck for removing waste from temporary holding tanks off of the barge and depositing the waste in the storage compartment of the barge;

c. a rechargable battery means for providing energy to the waste removal means; and d. solar powered means for recharging the rechargable battery.

2. A marine sanitation holding vessel as recited in claim 1, further comprising:

a. a filter compartment mounted on the upper deck of the barge, the filter compartment being in communication with the storage compartment;

b. a hollow mast having a first end in communication with the filter compartment and a second end extending above the upper deck of the barge; and c. means located in the filter compartment for filtering air passing from the storage compartment, through the filter compartment, and out of hollow mast.

3. A marine sanitation holding vessel as recited in claim 1, further comprising:

a. a filter compartment mounted on the upper deck of the barge, the filter compartment being in communication with the storage compartment; and b. a hollow mast having a first end in communication with the filter compartment and a second end extending above the upper deck of the barge; wherein at least a portion of the solar powered means is mounted on the second end of the hollow mast.

4. A marine sanitation holding vessel as recited in claim 3, in which the filter compartment is defined by a housing having an upper opening and a filter cover rotatably attached to the housing to selectively cover the upper opening, where the hollow mast is so attached to the filter cover that hollow mast rotates between: (a) a lowered position when the filter cover is open; and (b) a raised position when the filter cover is closed, where at least a portion of the solar powered means may be serviced when the hollow mast is in the lowered position.

5. A marine sanitation holding vessel as recited in claim 1, in which the barge further comprises an exterior structure, the exterior structure comprising:

a. an upper center wall;

b. a lower center wall;

c. port and starboard center walls;

d. first and second end upper walls;

e. first and second end lower walls;

h. port and starboard first end walls; and i. port and starboard second end walls.

6. A marine sanitation holding vessel as recited in claim 5, in which the upper center wall, the lower center wall, port and starboard center walls, first and second end upper walls, and first and second end lower walls are rectangular in shape prior to assembly of the vessel.

7. A marine sanitation holding vessel as recited in claim 6, in which upper, lower, port, and starboard center walls are fabricated from standard-sized sheets of material.

8. A marine sanitation holding vessel as recited in claim 7, in which the standard-sized sheets of material are 20'×6' sheets of aluminum.

9. A marine sanitation holding vessel as recited in claim 1, in which the barge comprises:

a. an exterior structure; and b. first and second interior walls; wherein the first end compartment is defined by the exterior structure and the first interior wall, the second end compartment is defined by the exterior structure and the second interior wall, and the storage compartment is defined by the exterior structure, the first interior wall, and the second interior wall.

10. A marine sanitation holding vessel as recited in claim 9, in which the exterior structure comprises:

a. an upper center wall;

b. a lower center wall;

c. port and starboard center walls;

d. first and second end upper walls;

e. first and second end lower walls;

h. port and starboard first end walls; and i. port and starboard second end walls.

11. A marine sanitation holding vessel as recited in claim 10, in which the first and second interior walls are connected to, and provide support to, the port and starboard center walls.

12. A marine sanitation holding vessel as recited in claim 11, in which the first and second interior walls are further connected to the upper and lower center walls, with an acute angle being formed between the interior walls and the upper and lower center walls.

13. A marine sanitation holding vessel as recited in claim 1, in which the waste removal means comprises first pump means being operable to pump waste from the temporary holding tanks into the storage compartment.

14. A marine sanitation holding vessel as recited in claim 13, in which the waste removal means further comprises pipe means for allowing communication between a source of cleansing fluid and the first pump means, where the first pump means is further operable to pump cleansing fluid from the source of cleansing fluid into the storage compartment.

15. A marine sanitation vessel as recited in claim 1, further comprising receptacle means for receiving waste and allowing waste to flow into the storage compartment.

16. A marine sanitation holding vessel as recited in claim 2, in which the hollow mast is painted black.

17. A marine sanitation holding vessel for collecting and storing waste material, comprising:

a. a barge having an upper deck, the barge defining first and second end compartments and a storage compartment, where the first and second end compartments are filled with material that provides buoyancy to the barge and the storage compartment contains waste material;

b. a filter compartment mounted on the upper deck of the barge, the filter compartment being in communication with the storage compartment;

c. a hollow mast having a first end in communication with the filter compartment and a second end extending above the upper deck of the barge; and d. means located in the filter compartment for filtering air passing from the storage compartment, through the filter compartment, and out of the hollow mast;

e. the filter compartment being arranged relative to the storage compartment and having a maintenance opening therein such that the air filtering means can be removed therefrom to allow cleaning of the storage compartment.

18. A marine sanitation holding vessel as recited in claim 17, in which the filter compartment is defined by a housing in which the maintenance opening is formed and a filter cover rotatably attached to the housing to selectively cover the maintenance opening, where the hollow mast is so attached to the filter cover that hollow mast rotates between: (a) a lowered position when the filter cover is open; and (b) a raised position when the filter cover is closed, where at least portions of the vessel may be serviced when the mast is in the lowered position.

19. A marine sanitation holding vessel for collecting and storing waste material, comprising:

a. a barge having an upper deck, the barge defining first and second end compartments and a storage compartment, where the first and second end compartments are filled with material that provides buoyancy to the barge and the storage compartment contains waste material;

b. a filter compartment mounted on the upper deck of the barge, the filter compartment being in communication with the storage compartment;

c. a hollow mast having a first end in communication with the filter compartment and a second end extending above the upper deck of the barge; and d. means located in the filter compartment for filtering air passing from the storage compartment, through the filter compartment, and out of hollow mast; wherein e. the filter compartment is defined by a housing having an upper opening and a filter cover rotatably attached to the housing to selectively cover the upper opening, where the hollow mast is so attached to the filter cover that hollow mast rotates between: (a) a lowered position when the filter cover is open; and (b) a raised position when the filter cover is closed, where at least portions of the vessel may be serviced when the mast is in the lowered position.

* * * * *